US012252369B2

(12) United States Patent
Henderickx et al.

(10) Patent No.: US 12,252,369 B2
(45) Date of Patent: Mar. 18, 2025

(54) SHEET STACKER MODULE

(71) Applicant: Canon Production Printing Holding B.V., Venlo (NL)

(72) Inventors: Johannes A. M. Henderickx, Venlo (NL); Hermanus M. Kuypers, Venlo (NL); Fabian T. Rosenboom, Venlo (NL); Lodewijk T. Holtman, Venlo (NL); Joshua D. Curran, Venlo (NL); Erik P. J. Verhoeven, Venlo (NL); Johannes E. P. Peulen, Venlo (NL); Maikel W. H. Bergmans, Venlo (NL); Luc Linders, Venlo (NL); Rob J. E. Looijmans, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 317 days.

(21) Appl. No.: 17/729,897

(22) Filed: Apr. 26, 2022

(65) Prior Publication Data

US 2022/0356034 A1 Nov. 10, 2022

(30) Foreign Application Priority Data

May 10, 2021 (EP) ..... 21173145

(51) Int. Cl.

| | |
|---|---|
| ***B65H 31/10*** | (2006.01) |
| ***B65H 31/30*** | (2006.01) |
| ***B65H 43/06*** | (2006.01) |

(52) U.S. Cl.

CPC ..... *B65H 31/10* (2013.01); *B65H 31/3054* (2013.01); *B65H 43/06* (2013.01); *B65H 2405/15* (2013.01)

(58) Field of Classification Search

CPC ..... B65H 3/10; B65H 3/3054; B65H 3/3063; B65H 43/06

See application file for complete search history.

(56) References Cited

U.S. PATENT DOCUMENTS 4,949,953 A * 8/1990 Claassen ..... B65H 31/32 414/796.1
5,672,045 A * 9/1997 Schmid ..... B65G 57/035 414/794.3

(Continued)

FOREIGN PATENT DOCUMENTS

CN 105692307 A * 6/2016
JP 61-89493 A 5/1986

(Continued)

OTHER PUBLICATIONS

European Search Report issued in Application No. EP 21173145 dated Oct. 29, 2021.

*Primary Examiner* — Patrick Cicchino
(74) *Attorney, Agent, or Firm* — Birch, Stewart, Kolasch & Birch, LLP

(57) ABSTRACT

A stacker module includes a lift table, a stacker configured to place sheets that are successively supplied thereto onto the top of a stack forming on the lift table, a controller configured to lower the lift table as the stack grows, a height-adjustable eject table, and an eject mechanism configured to transfer a completed stack from the lift table onto the eject table. The eject mechanism is height-adjustable for transferring stacks onto the eject table in different height positions of the lift table.

6 Claims, 2 Drawing Sheets

(56) References Cited

U.S. PATENT DOCUMENTS

| | | | | |
|---|---|---|---|---|
| 6,227,537 | B1 * | 5/2001 | Schmid | B65H 31/10 271/215 |
| 7,402,130 | B1 * | 7/2008 | Sjostedt | B65H 31/20 270/39.02 |
| 9,821,583 | B2 * | 11/2017 | Mutsuno | B65H 39/04 |
| 10,287,113 | B2 * | 5/2019 | Adami | B65G 57/035 |
| 10,414,615 | B2 * | 9/2019 | Adami | B65H 31/36 |
| 2012/0288354 | A1 | 11/2012 | Moore | |

FOREIGN PATENT DOCUMENTS

| | | | | |
|---|---|---|---|---|
| JP | 5-254711 | A | 10/1993 | |
| JP | 2004-43050 | A | 2/2004 | |
| WO | WO-0032505 | A2 * | 6/2000 | B65H 31/10 |

* cited by examiner

SHEET STACKER MODULE

BACKGROUND OF THE INVENTION

1. Field of the Invention

The invention relates to a stacker module comprising a lift table, a stacker configured to place sheets that are successively supplied thereto onto the top of a stack forming on the lift table, a controller configured to lower the lift table as the stack grows, a height-adjustable eject table, and an eject mechanism configured to transfer a completed stack from the lift table onto the eject table.

2. Description of Background Art

Stacker modules of this kind are provided for example at a discharge side of a printer, so that the print sheets leaving the printer may be stacked one upon the other. The stacker is installed at a fixed height, and the height of the lift table is controlled such that the top of the stack formed thereon is always kept in the same height, so that the stacker may smoothly place the sheets on top of the stack. The storage capacity of the lift table is exhausted when the lift table has reached a lowermost position. Then, the eject mechanism is activated so as to transfer the stack onto the eject table, from which the stack may be withdrawn either manually or by means of a conveyor. Meanwhile, the lift table returns to its topmost position, so that a new stack may be started.

US 2012 288354 A1 discloses a stacker module of the type indicated above, wherein the eject table is also adjustable in height, so that a stack that has been transferred thereto may be lifted into a position in which the stack can more conveniently be removed by the service personnel.

SUMMARY OF THE INVENTION

It is an object of the invention to improve the efficiency of the stacker module.

In order to achieve this object, the method according to claim 1 and the stacker module according to claim 2 are provided. These are characterized in that the eject mechanism is height-adjustable for transferring stacks onto the eject table in different height positions of the lift table and by the steps of:

- stacking the successive sheets on top of a stack forming on a lift table;
- lowering the lift table as the stack grows; and
- activating an eject mechanism for transferring a completed stack from the lift table onto an eject table,
- determining a target height of a stack to be formed on the lift table;
- moving the lift table, the eject mechanism and the eject table to a height position at which the lift table will arrive as soon as the stack has reached the target height; and
- activating the eject mechanism as soon as the lift table has arrived in that height position.

Under certain conditions, the stacker module is required to form stacks that are smaller than a stack corresponding to the full storage capacity of the lift table. For example, if a printer processes several print jobs one after the other, it is desired that separate stacks are formed for each print job, and if a job is relatively short, then the corresponding stack will be completed already before the storage capacity of the lift table is exhausted. In conventional stacker modules, it was necessary in such cases to lower the lift table to the lowermost position so that the eject mechanism could be activated for transferring the stack onto the eject table which, if it was height adjustable at all, was also kept in its lowermost position. Consequently, after completion of each small stack, the lift table had to be lowered into the lowermost position and then, when the stack had been transferred, it had to be lifted again into the topmost position. During this time, no sheets exciting from the printer could be stacked, so that the operation of the printer had to be interrupted.

In the stacker module according to the invention, both, the eject mechanism and the eject table are adjustable in height, so that they can both be brought into a height position in which the stack can readily be transferred as soon as it has become completed, so that less time is required for lowering and lifting the lift table, and the print process does not need to be interrupted or at least has to be interrupted only for a shorter time.

More specific optional features of the invention are indicated in the dependent claims.

The eject mechanism may be adjustable in height independently of the lift table or synchronously with the lift table. In yet another embodiment, the eject mechanism or at least parts thereof may be integrated into the lift table.

Optionally, parts of the eject mechanism may also be integrated into the eject table.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
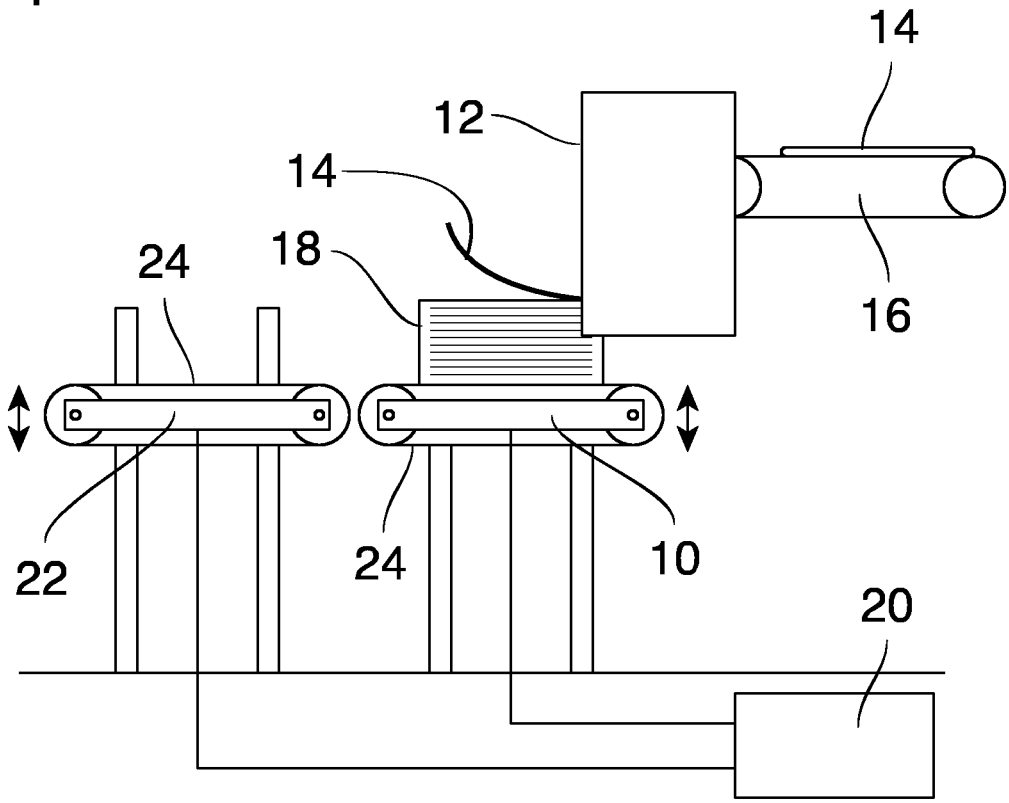
FIG. 1 is a schematic view of a stacker module in operation.

The present invention will now be described with reference to the accompanying drawings, wherein the same reference numerals have been used to identify the same or similar elements throughout the several views.

The stacker module shown in FIG. 1 comprises a lift table 10, a stacker 12 that has been installed in a fixed height for receiving sheets 14 that are successively supplied on a conveyor 16, and for placing the sheets 14 on top of a stack 18 that is forming on the lift table 10.

As is well known in the art, the stacker 12 may be configured for aligning the sheets 14 with the stack 18 and optionally also for flipping over the sheets 14 as they are placed onto the stack.

As is also well known in the art, the lift table 10 is height-adjustable, and a controller 20 is provided for controlling the height of the lift table 10, in particular for lowering the lift table in synchronism with the operating cycle of the stacker 12, so that the top of the stack 18 is always kept at a constant level while the height of the stack increases.

The stacker module further comprises an eject table 22 disposed adjacent to an eject side of the lift table 10. The eject table 22 is also height-adjustable under the control of the controller 20.

In the embodiment shown here, conveyors 24 are integrated into both, the lift table 10 and the eject table 22, and these conveyors 24, together, form an eject mechanism for transferring a completed stack 18 from the lift table 10 onto the eject table 22. When the eject mechanism is activated, the two conveyors 24 are driven for rotation so as to smoothly move the stack 18 from the lift table 10 to the eject table 22, as has been illustrated in FIG. 2.

Figure 2:
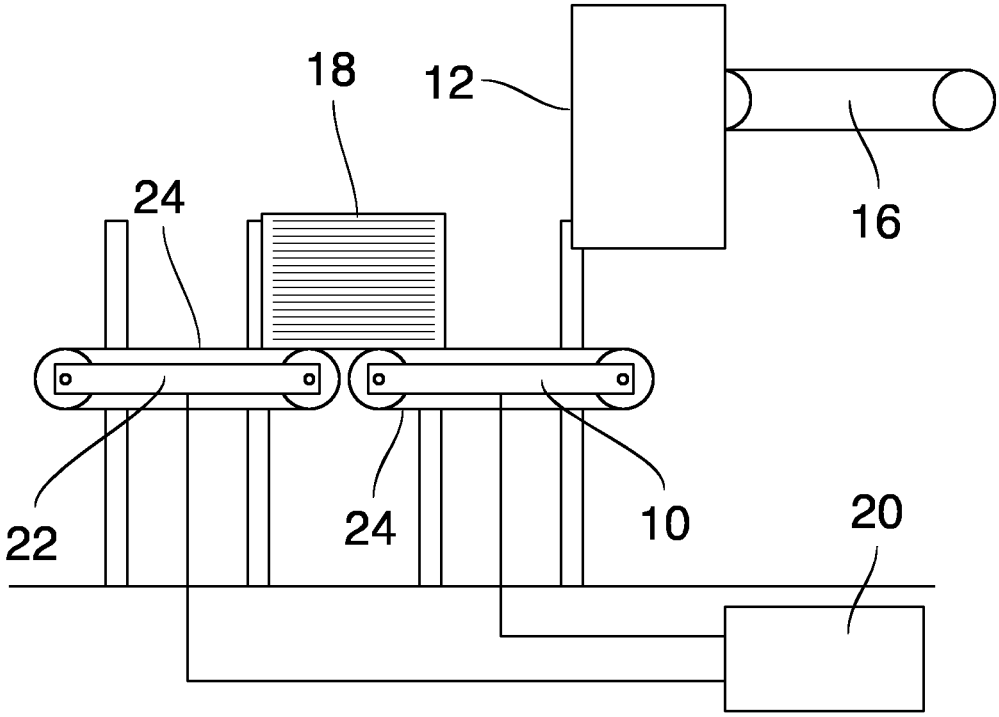
FIG. 2 shows the stacker module in a state in which a completed stack is transferred onto an eject table.

It will be observed that, in FIG. 2, the stack 18 has a larger height than in FIG. 1, because more sheets have been stacked before the stack has reached its target height which is determined for example by the number of sheets that belong to a single print job. Consequently, the lift table 10 and the eject table 22 as well as the integrated eject mechanism have reached positions that are lower than the positions shown in FIG. 1.

Figure 3:
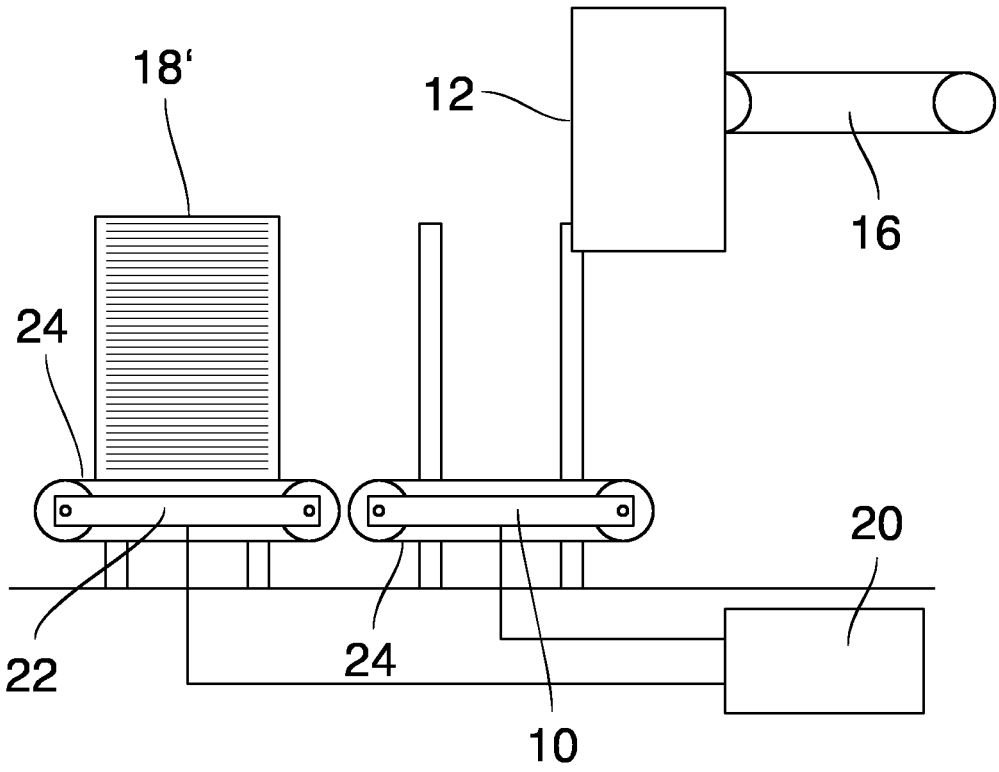
FIG. 3 shows the stacker module in a condition in which a stack that has a larger height than the stack in FIG. 2 has been ejected onto the eject table.

For comparison, FIG. 3 illustrates a situation where a stack 18' that had a larger target height has been transferred onto the eject table 22. At the time of the transfer, the eject table 22 and the lift table 10 as well as their eject mechanism have positions that are significantly lower than the positions shown in FIG. 2.

It is an outstanding feature of the invention that the eject mechanism constituted by the conveyors 24 can be activated in any desired height position of the lift table 10 and the eject table 22. This has the advantage that the stacker module and also the printer from which the sheets 14 have been discharged via the conveyor 16 can operate more efficiently, in particular in cases where the stacks to be formed have only a small target height, significantly smaller than the maximum storage capacity of the lift table 10.

For example, while a print job is being processed and the printed sheets 14 are stacked as in FIG. 1, information on the total number of sheets to be printed in the current print job as well as information on the thickness of the sheets may be transferred from the printer controller to the controller 20 of the stacker module and may be used there for calculating the target height of the stack. Then, while the lift table 10 is gradually lowered in synchronism with the growth of the stack 18, the eject table 22 can be adjusted in advance to a calculated height position which the lift table 10 will reach when the stack is completed. Then, as soon as the stack is actually completed and the lift table 10 has reached this height position, the eject mechanism (conveyors 24) can be activated without delay, so that the stack can immediately be transferred onto the eject table 22. As soon as the stack 18 has left the conveyor of the lift table 10, this lift table can already be lifted again into the position suitable for starting a new stack. It is not even necessary to wait until the stack has reached its final position on the eject table 22. Consequently, the time in which the flow of sheets 14 to the stacker module must be interrupted can be reduced significantly as compared to a conventional scenario wherein, when the target height of the stack has been reached, the lift table 10 must first be lowered into the lowermost position in which the eject table 22 and the transfer mechanism are available, and then, when the stack has been transferred, the lift table 10 must be moved all the way up from its lowermost position to its topmost position.

Of course, the height-adjustable eject table 22 may also be used for lifting the stack that has been transferred thereon to a height position which is convenient for removal of the stack from the eject table, and this most convenient height position may even be adjusted to the actual height of the respective stack.

It is not compulsory that the eject mechanism is integrated into the lift table 10 and the eject table 22 as in the embodiment illustrated here. For example, the eject mechanism could also be constituted by a pusher mechanism that is adjustable in height independently of the lift table 10.

In another embodiment, the conveyor 24 of the lift table 10 may be extended into the area of the eject table 22. For example, the conveyor 24 of the lift table could be formed by a number of parallel separate conveyor belts that can engage into gaps formed in the eject table 22, so that the stack can be moved onto the eject table 22 by means of the conveyor of the lift table 10, and the eject table 22 does not need to have its own conveyor. During the transfer of the stack, the eject table 22 may be held in a position slightly lower than that of the lift table 10, and then, when the stack has reached its position on (or rather above) the eject table 22, this eject table is slightly lifted above the height of the lift table 10, so that the stack is then supported of on the eject table. Then, in order to quickly return the lift table 10 to the position for starting a new stack, the lift table and the eject table may jointly be moved upwards, with the eject table 22 always being slightly ahead of the lift table.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method of stacking sheets that are successively supplied to a stacker module, the method comprising the steps of:

stacking the successive sheets on top of a stack forming on a lift table;

lowering the lift table as the stack grows;

activating an ejector for transferring a completed stack from the lift table onto an eject table;

calculating a target height of a stack to be formed on the lift table based on a number of sheets in a print job;

determining a height position for the eject table based on the target height of the stack, at which height position the lift table will arrive when the stack has reached the target height;

moving the ejector and the eject table to the height position; and activating the ejector as soon as the lift table has arrived in said height position.

2. A software product embodied on a non-transitory computer readable medium and comprising computer-executable program code that, when loaded into a controller of a stacker module causes the controller to control the stacker module to perform the method according to claim 1.

3. A stacker module comprising:

a lift table;

a stacker configured to place sheets that are successively supplied thereto on top of a stack forming on the lift table;

a controller configured to lower the lift table as the stack grows;

a height-adjustable eject table; and an ejector configured to transfer a completed stack from the lift table onto the eject table, wherein the ejector is height-adjustable for transferring stacks onto the eject table in different height positions of the lift table, the stacker module further comprising a controller configured to have the stacker module perform the steps of:

stacking the successive sheets on top of the stack forming on the lift table;

lowering the lift table as the stack grows;

activating the ejector for transferring the completed stack from the lift table onto the eject table;

calculating a target height of the stack to be formed on the lift table based on a number of sheets in a print job;

determining a height position for the eject table based on the target height of the stack, at which height position the lift table will arrive when the stack has reached the target height moving the ejector and the eject table to the height position; and activating the ejector as soon as the lift table has arrived in said height position.

4. The stacker module according to claim 3, wherein the ejector comprises a first conveyor that is integrated into the lift table.

5. The stacker module according to claim 4, wherein the ejector comprises a second conveyor that is integrated into the eject table.

6. A sheet printer comprising the stacker module according to claim 3.

* * * * *